US006095773A

United States Patent [19]

Merz

[11] Patent Number: 6,095,773

[45] Date of Patent: Aug. 1, 2000

[54] VANE CELL PUMP

[75] Inventor: Johann Merz, Schwäbisch Gmünd, Germany

[73] Assignee: ZF Friedrichshafen AG, Friedrichshafen, Germany

[21] Appl. No.: 09/254,259

[22] PCT Filed: Aug. 29, 1997

[86] PCT No.: PCT/EP97/04713

§ 371 Date: Mar. 4, 1999

§ 102(e) Date: Mar. 4, 1999

[87] PCT Pub. No.: WO98/10192

PCT Pub. Date: Mar. 12, 1998

[30] Foreign Application Priority Data

Sep. 4, 1996 [DE] Germany ..... 196 35 801

[51] Int. Cl.[7] ..... F04B 23/00

[52] U.S. Cl. ..... 417/540

[58] Field of Search ..... 417/540; 418/181, 418/157

[56] References Cited

FOREIGN PATENT DOCUMENTS

| | | |
|---|---|---|
| 237970 | 5/1978 | France . |
| 1553008 | 7/1969 | Germany . |
| 4120757 | 1/1992 | Germany . |
| 4416077 | 11/1995 | Germany . |

*Primary Examiner*—Timothy S. Thorpe
*Assistant Examiner*—Trelita L Perry
*Attorney, Agent, or Firm*—Larson & Taylor PLC

[57] ABSTRACT

A vane cell pump with a cup-shaped case top (2) for receiving a pump package (3). The cup-shaped case top (2) is axially extended and contains a damper (14) for the purpose of an effective pressure fluctuation absorption. The case top (2) has an inwardly projecting extension (6) for supporting the pump package (3) in one embodiment. A piston (15), which can be displaced against a spring (18), can be arranged on the extension (6) for improving the damper action in another embodiment.

20 Claims, 3 Drawing Sheets

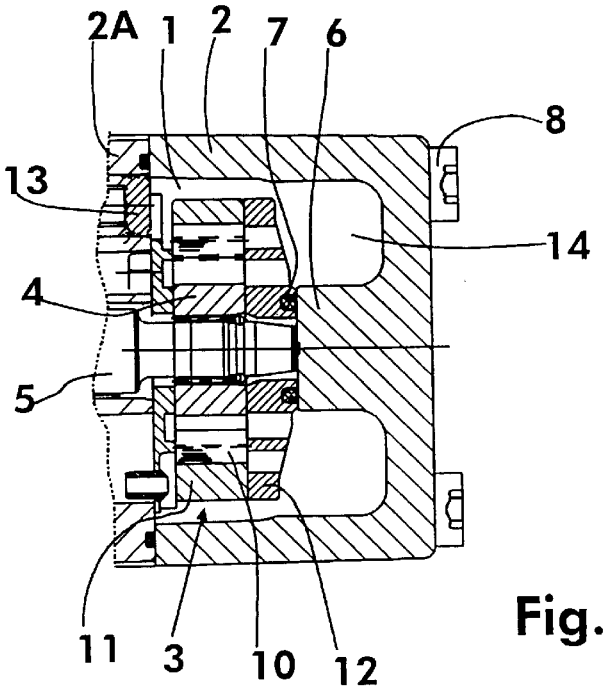
Fig. 1
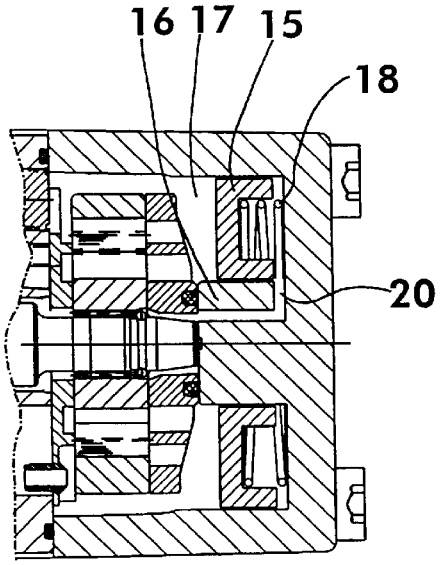
Fig. 2
Fig. 3
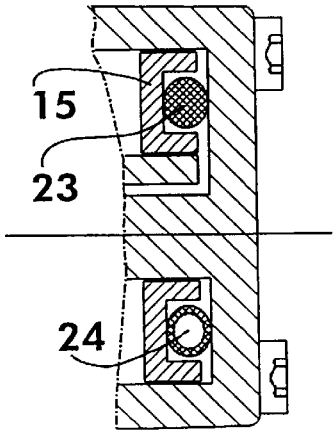
Fig. 4

VANE CELL PUMP

FIELD OF THE INVENTION

The invention relates to a vane cell pump for the delivery of hydraulic oil from a reservoir to a consumer. A pump package, consisting of a rotor, several work slides and a cam ring, has been inserted into an interior chamber of a cup-shaped case top of the vane cell pump. Work chambers, divided by the work slides, are formed between the cam ring and the rotor, which are delimited in the axial direction by control plates. A bearing housing, which contains suction and pressure ducts connecting the work chambers with the suction connector, a flow control valve and a pressure control valve, adjoins the cup-shaped case top on the one side.

BACKGROUND OF THE INVENTION

Such a vane cell pump is known from DE 44 16 077 A1. This pump is distinguished by a sturdy construction and advantageous production/assembly costs. A vane cell pump does not deliver oil continuously, but unevenly in partial volumes per revolution. The cyclically delivered volumes cause pressure fluctuations, pressure vibrations and/or pulsations, in particular on the pressure side. Intake and exhaust shocks, which are generated during the opening and closing of the work chambers, are superimposed on the pressure vibrations.

BRIEF SUMMARY OF THE INVENTION

The invention is based on such a structure of a vane cell pump and has the object of improving the noise conditions caused by the pulsations and pressure fluctuations.

This object is attained by means of the vane cell pump characterized in that the cup-shaped case top arranged on an opposite side of a bearing housing is axially extended and contains a damper for absorbing vibrations. In addition, the case top has an inwardly projecting extension for supporting the pump package. The integration of the damper into the top only requires little additional space, but constitutes a cost-effective, space-saving solution for effective pulsation absorption. The extension which is additionally provided in the housing is used by a control plate, together with the pump package, for support under high pressure and thus for good sealing.

Advantageous embodiments and further damper embodiments are recited hereafter.

Thus, for an improved effect of the damper it is possible to guide a spring-loaded piston on the extension, and the rear chamber created by the piston can be relieved through an absorption bore in the extension. In place of a spring, the piston can also be cushioned against a seal ring. This results in a particularly inexpensive absorbing arrangement.

In accordance with a preferred embodiment a piston, into which several flexible elements have been placed, is provided in the damper. In this embodiment the piston is supported on a sealed housing edge and generates a relief chamber on its rear end. Preferably conical plugs made of a plastic material have been inserted as the flexible elements into appropriate openings, which taper in the direction toward the relief chamber. It has been shown that the flexible elements are suitable for further improved vibration absorption.

In accordance with a further preferred embodiment, an annular groove with a flexible ring is provided in the piston. The annular groove is connected via small bores with a relief chamber. Good results for lowering pressure fluctuations can be achieved by the displacement of the flexible ring into the small bores.

BRIEF DESCRIPTION OF THE DRAWINGS

The invention will be explained in greater detail in what follows by means of several exemplary embodiments represented in the drawings.

Shown are in:

FIG. 1, a partial cross section through a case top of the vane cell pump in accordance with the invention with a damper chamber;

FIG. 2, a partial cross section in accordance with FIG. 1 with a cushioned piston;

FIGS. 3 and 4, partial cross sections in accordance with FIG. 1, wherein the piston is cushioned against flexible rings;

DESCRIPTION OF THE PREFERRED EMBODIMENTS

Figure 5:
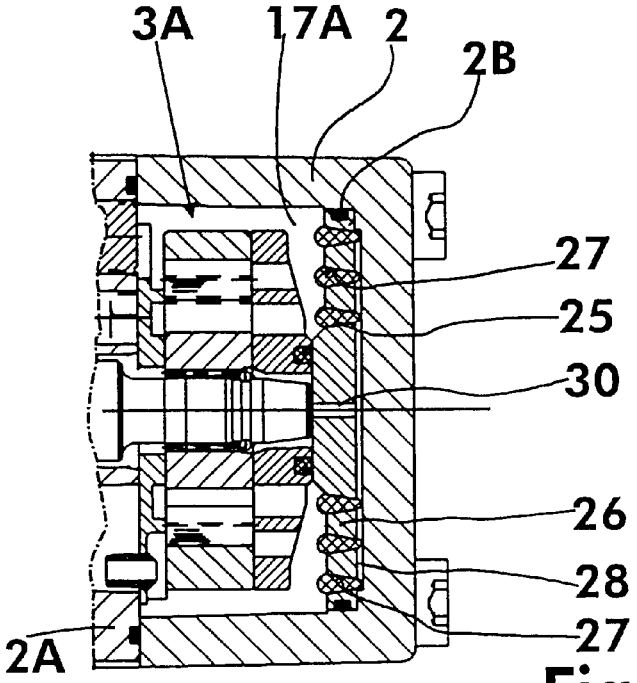
FIG. 5, a partial cross section in accordance with FIG. 1, wherein the piston contains flexible elements.

The vane cell pump has a structure corresponding to DE 44 16 077 A1 and will be described in what follows only by means of the components which are most important for understanding.

A pump package 3 has been inserted into a pressure chamber 1 of a case top 2. A rotor 4 is supported via an input shaft 5 in a bearing housing 2A. The bearing point in the bearing housing 2A is the sole bearing of the input shaft 5. The input shaft 5 is suitably supported in the axial direction only by an extension 6 of the case top 2. A gasket 7 provides a seal against high pressure. The case top 2 is fastened by means of screws 8 on the bearing housing 2A. The pump package 3 has work slides 10, which are guided in radial slits of the rotor 4 and which perform a lifting movement in a cam ring 11 during rotation. Work chambers are located between the cam ring 11, the rotor 4, the work slides 10 and lateral control plates 12, 13. In accordance with the invention the case top 2 has been extended in such a way that a damper 14, which is connected with the pressure chamber 1, is created in the area of the extension 6. This damper 14 is selected to be sufficiently large so that pressure fluctuations of the vane cell pump are effectively absorbed. With the pump operating, the entire pump package 3 is advantageously pushed toward the right against the extension 6 by the high pressure, so that a good gap seal between the pump package 3 and the control plates 12, 13 is assured.

FIG. 2 represents an embodiment with an additional annular piston 15, which is guided on an extension 16. The annular piston 15 is arranged in a damper 17 and is sealed between the case top 2 and the extension 16. A spring 18 absorbs the piston movements. Another absorption bore 20 with a narrow cross section is located in the extension 16. Even large pressure fluctuations can be dependably absorbed by means of such an arrangement.

In accordance with FIGS. 3 and 4 it is practical to provide, depending on its use, an O-seal ring 23, which is solid in cross section, or a hollow chamber seal ring 24, in place of the spring 18.

FIG. 5 represents a further embodiment of a damper 17A with conical elements 25 in a piston 26. The conical elements 25 are flexible and absorb the pressure fluctuations by being displaced to a greater or lesser extent in conical recesses 27. The elements 25 taper in the direction toward a relief chamber 28 behind the piston 26. The relief chamber 28 is constituted by a housing edge 2B, against which the piston 26 rests. A pump package 3A is supported on the piston 26. The chamber 28 is connected via an absorption bore 30 to the relief front chamber 31.

Figure 6:
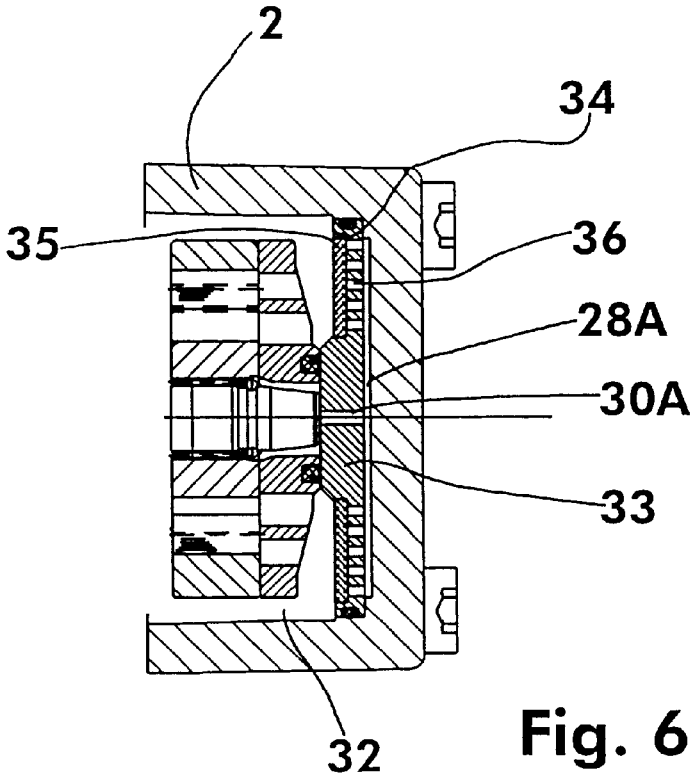
FIG. 6, a partial cross section in accordance with FIG. 1 with a flexible ring inserted into an annular groove of a piston.

A variant with a piston 33 arranged in a damper 32 is represented in FIG. 6. The piston 33 contains a flexible ring 35 in an annular groove 34. A chamber 28A toward the rear is relieved by means of an absorption bore 30A. Small bores 36 have been cut into the seating surface of the flexible ring, which also are used as displacement spaces for the ring 35.

With the embodiments of FIGS. 3 to 6, elastomers are suitably used as the flexible members.

Figure 7:
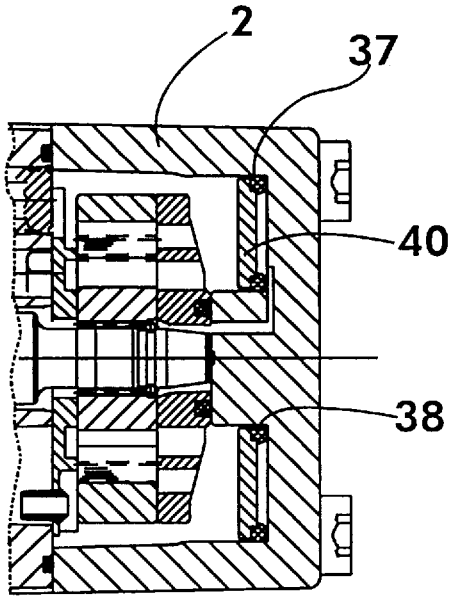
FIG. 7 is a partial cross section in accordance with FIG. 1, wherein an annular piston engages seal rings.
Figure 8:
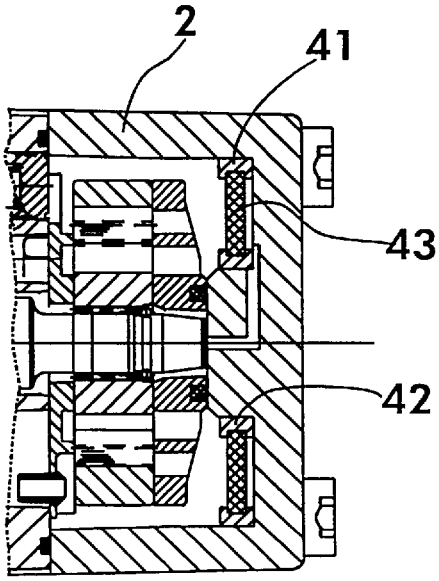
FIG. 8 is a partial cross section in accordance with FIG. 1, wherein a flexible piston is mounted between holding elements.

A further embodiment is depicted in FIG. 7 where an annular piston 40 is engaged with flexible seal rings 37 and 38. A final embodiment is depicted in FIG. 8 where a flexible piston 43 is mounted between holding elements 41 and 42.

What is claimed is:

1. A vane cell pump for delivering hydraulic oil from a container to a consumer comprising:

a pump package including a rotor defining axial and radial directions, a plurality of work slides, and a cam ring;

divided work chambers formed by the work slides between the cam ring and the rotor, the work chambers being closed by control plates in both axial directions;

a cup-shaped case top including (a) an open axial side and an opposite closed axial side, and (b) an interior chamber in which said pump package is located, said interior chamber being located between the open axial side and the closed axial side;

a supporting surface located inwardly from the closed axial side on which the pump package is supported, the supporting surface having an extension portion of the interior chamber thereabout;

a damper for the absorption of vibrations located in the extension portion of the interior chamber; and a bearing housing axially adjoining the open side of the case top and which contains suction and pressure ducts for connecting the work chambers with a suction connector, a flow control valve and a pressure control valve.

2. The vane cell pump as claimed in claim 1, wherein said supporting surface is an inward end of an extension of the cup-shaped case top projecting inwardly from the closed axial side.

3. The vane cell pump as claimed in claim 2, wherein said damper includes a piston guided for axial movement on the extension, a rear chamber on a side of the piston opposite to the pump package which is relieved by an absorption bore, and a spring means for absorbing vibrations exerted on the piston.

4. The vane cell pump as claimed in claim 3, wherein the spring means is a spring which mounts the piston away from the closed side.

5. The vane cell pump as claimed in claim 4, wherein the spring is a seal ring.

6. The vane cell pump as claimed in claim 4, wherein the spring is a plurality of seal rings.

7. The vane cell pump as claimed in claim 3, wherein the piston includes a ring portion which is flexible and which serves as the spring means.

8. The vane cell pump as claimed in claim 1, wherein the damper includes:

a piston mounted in the extension portion, the piston having apertures therein and supporting the pump package on an inward surface thereof forming the supporting surface, a rear chamber between the piston and the closed side, the rear chamber being relieved by an absorption bore, and a flexible means located in said extension chamber adjacent the apertures for being flexibly pushed into said apertures in the piston by fluctuations in pressure in the extension portion.

9. The vane cell pump as claimed in claim 8:

wherein the piston includes a housing edge which seals with the cup-shaped case top; and wherein the flexible means is a plurality of discrete flexible elements, each flexible element being located in a respective aperture of the piston.

10. The vane cell pump as claimed in claim 9:

wherein the apertures of the piston are axially disposed;

wherein the flexible elements are conical plugs made of a plastic material which have been inserted into the openings in the piston; and wherein the flexible elements taper in the axial direction toward the rear chamber.

11. The vane cell pump as claimed in claim 8:

wherein the piston includes a housing edge which seals with the cup-shaped case top; and wherein the piston includes an annular groove adjacent a groove portion with the groove portion containing small bores forming the apertures; and wherein the flexible means is a flexible ring inserted into the annular groove of the piston which is partially displaced into the small bores of the groove portion by the fluctuations.

12. A vane cell pump for delivering hydraulic oil from a container to a consumer comprising:

a pump package including a rotor defining axial and radial directions, a plurality of work slides, and a cam ring;

divided work chambers formed by the work slides between the cam ring and the rotor, the work chambers being closed by control plates in both axial directions;

a cup-shaped case top including (a) an open axial side and an opposite closed axial side, (b) an interior chamber in which said pump package is located, said interior chamber being located between the open axial side and the closed axial side, and (c) an extension projecting inwardly from the closed axial side to an inward end thereof on which the pump package is supported, the extension having an extension portion of the interior chamber thereabout;

a damper for the absorption of vibrations located in the extension portion of the interior chamber; and a bearing housing axially adjoining the open side of the case top and which contains suction and pressure ducts for connecting the work chambers with a suction connector, a flow control valve and a pressure control valve.

13. The vane cell pump as claimed in claim 12, wherein said damper includes a piston guided for axial movement on the extension, a rear chamber on a side of the piston opposite to the pump package which is relieved by an absorption bore, and a spring which mounts said piston away from the closed side.

14. The vane cell pump as claimed in claim 13, wherein the spring is a seal ring.

15. The vane cell pump as claimed in claim 13, wherein the spring is a plurality of seal rings.

16. The vane cell pump as claimed in claim 12, wherein said damper includes a piston guided for axial movement on the extension, the piston including a ring portion which is flexible and which serves to absorb vibrations.

17. A vane cell pump for delivering hydraulic oil from a container to a consumer comprising:

a pump package including a rotor defining axial and radial directions, a plurality of work slides, and a cam ring;

divided work chambers formed by the work slides between the cam ring and the rotor, the work chambers being closed by control plates in both axial directions;

a cup-shaped case top including an open axial side and an opposite closed axial side, and an interior chamber in which said pump package is located, said interior chamber including an extension portion adjacent the closed axial side;

a damper for the absorption of vibrations located in the extension portion of the interior chamber, said damper including a piston mounted in the extension portion, the piston having apertures therein and supporting the pump package thereon, a rear chamber between the piston and the closed side, the rear chamber being relieved by an absorption bore, and a flexible means located in said extension chamber adjacent the apertures for being flexibly pushed into said apertures in the piston by fluctuations in pressure in the extension portion; and a bearing housing axially adjoining the open side of the case top and which contains suction and pressure ducts for connecting the work chambers with a suction connector, a flow control valve and a pressure control valve.

18. The vane cell pump as claimed in claim 17:

wherein the piston includes a housing edge which seals with the cup-shaped case top; and wherein the flexible means is a plurality of discrete flexible elements, each flexible element being located in a respective aperture of the piston.

19. The vane cell pump as claimed in claim 18:

wherein the apertures of the piston are axially disposed;

wherein the flexible elements are conical plugs made of a plastic material which have been inserted into the openings in the piston; and wherein the flexible elements taper in the axial direction toward the rear chamber.

20. The vane cell pump as claimed in claim 17:

wherein the piston includes a housing edge which seals with the cup-shaped case top; and wherein the piston includes an annular groove adjacent a groove portion with the groove portion containing small bores forming the apertures; and wherein the flexible means is a flexible ring inserted into the annular groove of the piston which is partially displaced into the small bores of the groove portion by the fluctuations.

* * * * *